US006755387B2

(12) United States Patent
Lopez et al.

(10) Patent No.: US 6,755,387 B2
(45) Date of Patent: Jun. 29, 2004

(54) TRANSITION STRIP FOR DISPARATE CONCRETE FORMS

(75) Inventors: Manny Lopez, Arlington Heights, IL (US); Bryant Bird, Jr., Spring, TX (US); Michael Miller, Medinah, IL (US)

(73) Assignee: Symons Corporation, Des Plaines, IL (US)

( * ) Notice: Subject to any disclaimer, the term of this patent is extended or adjusted under 35 U.S.C. 154(b) by 0 days.

(21) Appl. No.: 10/071,517

(22) Filed: Feb. 7, 2002

(65) Prior Publication Data

US 2002/0125404 A1 Sep. 12, 2002

Related U.S. Application Data

(60) Provisional application No. 60/267,321, filed on Feb. 8, 2001.

(51) Int. Cl.[7] ..... E04G 11/08; E04G 17/00

(52) U.S. Cl. ..... 249/193

(58) Field of Search ..... 249/44, 45, 47, 249/191, 192, 193, 194, 196, 217

(56) References Cited

U.S. PATENT DOCUMENTS 1,694,292 A * 12/1928 Tracey ..... 249/27
2,526,381 A * 10/1950 Mathis ..... 249/196
6,502,802 B2 * 1/2003 Jorn et al. ..... 249/194

FOREIGN PATENT DOCUMENTS

CA 605806 * 9/1960 ..... 249/192

* cited by examiner

*Primary Examiner*—Michael Safavi
(74) *Attorney, Agent, or Firm*—Wood, Herron & Evans LLP

(57) ABSTRACT

A transition system for concrete forms includes a first concrete-forming panel having a first thickness and arranged to receive a first attachment mechanism, a second concrete-forming panel having a second thickness greater than the first thickness and arranged to receive a second attachment mechanism, and a transition strip sized for placement between the first and second concrete-forming panels. The transition strip includes a first side edge sized to match the first thickness and arranged to receive the first attachment mechanism, a second side edge sized to match the second thickness and arranged to receive the second attachment mechanism, a skin extending between the first and second side edges and arranged to cooperate with the first concrete-forming panel and the second concrete-forming panel to form a generally uninterrupted concrete-forming surface, and a plurality of stiffeners extending between the first side edge and the second side edge.

28 Claims, 15 Drawing Sheets

TRANSITION STRIP FOR DISPARATE CONCRETE FORMS

PRIORITY CLAIM

This application claims the priority benefit of U.S. Provisional Application No. 60/267,321 filed Feb. 8, 2001, the entire disclosure of which is incorporated herein by reference.

TECHNICAL FIELD

The present invention relates to concrete forming systems and, more specifically, to a transition strip that permits disparate modular concrete forms to be attached to each other.

BACKGROUND OF THE INVENTION

Modular forming systems are generally well known in the art. Modular forming systems are favored because they permit the rapid assembly of concrete forms, such as concrete wall forms, of practically any dimension. Modular form systems typically use a discrete number of premanufactured modular form sections that may be rapidly assembled and for use. After use, the forms are disassembled and reassembled at a different location.

Typically, a modular wall form system will employ any number of discrete sections, all of which are manufactured according to a governing standard. For example, in the U.S. such systems will be manufactured using imperial dimensions (e.g., feet and inches). On the other hand, many form systems of foreign origin are manufactured using metric dimension (e.g., meters and centimeters).

As further examples, a particular manufacturer of form panels may construct panels sized and shaped to be secured to each other using a specific type of clamping or attachment mechanism, while another manufacturer may construct panels sized and shaped to be secured to each other using another and different type of clamping or attachment mechanism. There presently are many different manufacturers of modular form systems, each manufacturing form panels with varying thicknesses, varying edge features, with each of these various panels being designed for securement to adjacent panels using a specific type of attachment mechanism.

Different form panels may offer certain advantages in certain circumstances. Thus, it may be desirable to use different form panels in a common application. For example, a form panel constructed according to metric standard may offer certain advantages in one section of a concrete wall, while a form panel constructed according to an imperial standard may offer certain advantages in another, adjacent section of the same concrete wall. Similarly, one type of attachment mechanism may offer certain advantages in certain areas of a concrete wall form, (e.g., in corners), while another type of attachment mechanism may offer different advantages in other areas of a concrete wall form, (e.g., in straight or curved sections).

Therefore, in order to facilitate the use of disparate wall panels in a common application, it is necessary to have a system that will permit the attachment of metric wall panels to imperial wall panels, or that will permit the attachment of wall panels that employing disparate attachment mechanisms.

DETAILED DESCRIPTION

The embodiments described herein are not intended to be exhaustive or to limit the scope of the invention to the precise form or forms disclosed. Instead, the following embodiments have been described in order to best explain the principles of the invention and to enable others skilled in the art to follow its teachings.

Figure 1:
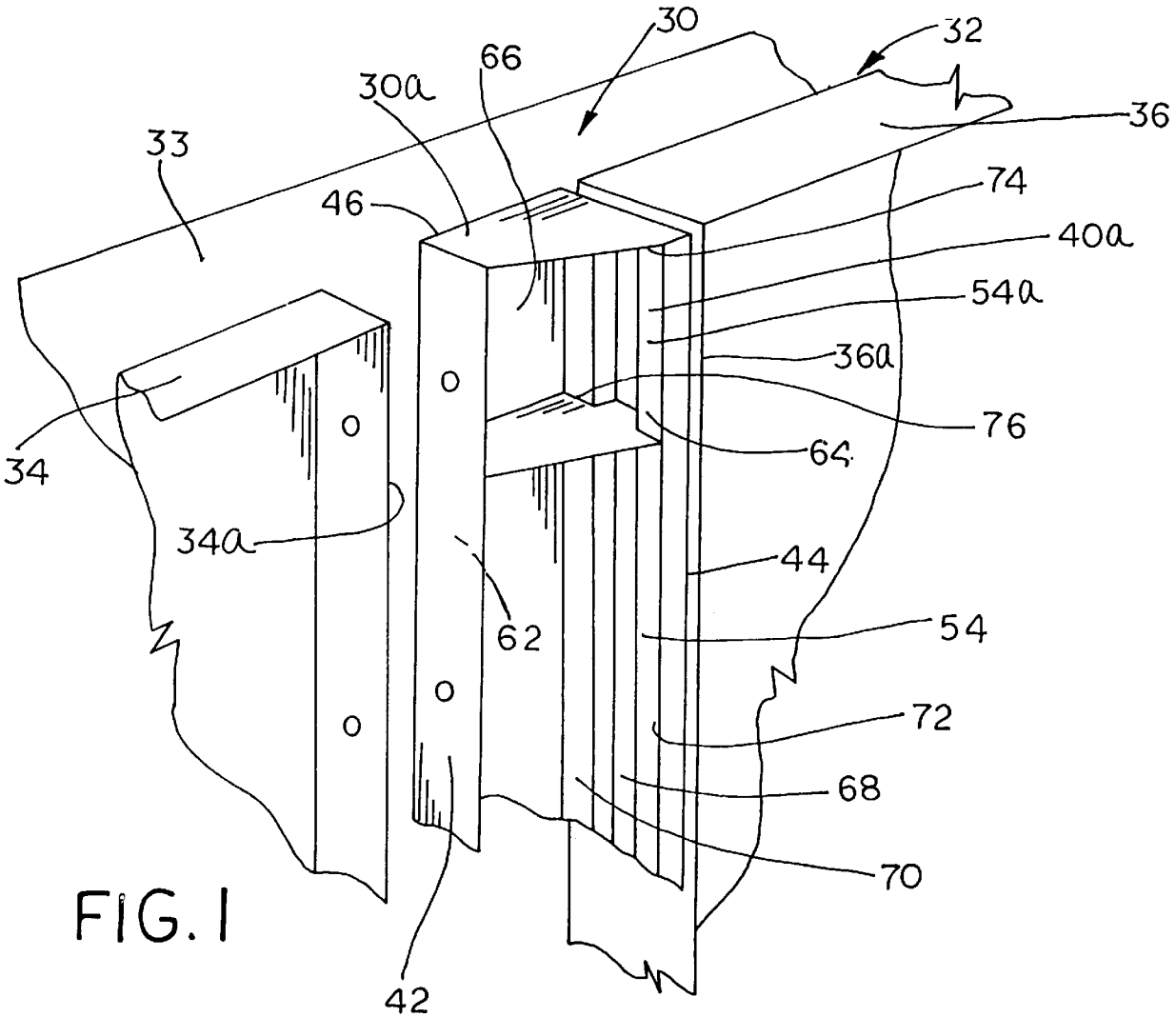
FIG. 1 is a fragmentary view in perspective of a transition strip constructed in accordance with the teachings of the present invention, which transition strip is shown interposed between two disparately sized concrete wall form panels.

Referring now to FIGS. 1–5 of the drawings, a transition strip constructed in accordance with the teachings of a first disclosed embodiment of the present invention is shown and is generally referred to by the reference numeral 30. As shown in FIG. 1, the transition strip 30 is used to assemble a modular wall form system 32 having a plurality of wall panels 34, 36. It will be understood that a number of additional wall panels (not shown) will typically be provided in order to assemble a complete modular wall system 32. Further, it will be understood that the modular wall form system 32 typically includes a plurality of interconnected panels on two opposite sides of a concrete-receiving cavity 33 into which is poured uncured concrete as is known to those of skill in the art. For the sake of convenience, only a single side of the modular wall system 32 will be described herein in any detail, the other side (not shown) of the system 32 may be substantially similar to that discussed herein, or it may be a conventional wall form. Also, the transition strip 30 may be used to attach additional wall panels (not shown) stacked on top of the illustrated wall panels 34, 36 in order to assemble a taller modular wall form system 32 necessary to construct a taller concrete wall. For the sake of convenience however, only a single set of the wall panels 34 and 36 and a single one of the transition strips 30 will be discussed in detail herein.

As shown in FIG. 1, the wall panel 34 includes a vertical edge 34*a*, while the wall panel 36 includes a vertical edge 36*a*. The vertical edge 34*a* of the wall panel 34 includes a plurality of attachment holes arranged according to a standardized pattern. The attachment holes thus facilitate attachment of the vertical edge 34*a* of the wall panel 34 to the transition strip 30 as will be explained in greater detail below. As would be known to those of skill in the art, the standardized pattern may take one of a number of possible forms, as will be outlined in greater detail below.

The vertical edge 36*a* of the wall panel 36 includes a shaped side member 40. The shaped side member 40 is sized and shaped to accept a standardized attachment clamp 42 (see FIG. 8). The shaped side member 40 thus facilitates the attachment of the vertical edge 36*a* of the wall panel 36 to the transition strip 30 as will be explained in greater detail below. As would be known to those of skill in the art, the details of the cross-section of the shaped side member 40 may vary according to one of a number of possible standardized forms in order to facilitate the use of one of a number of possible attachment clamps.

Figure 2:
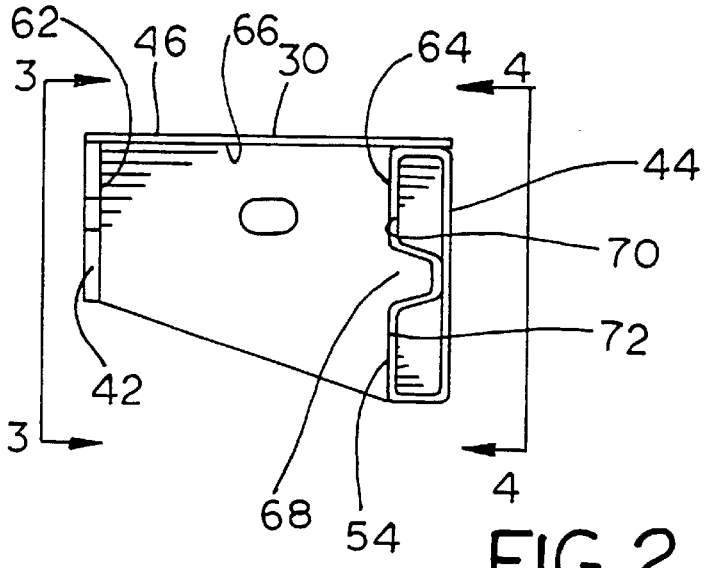
FIG. 2 is a top plan view of the transition strip shown in FIG. 1.

As shown in FIGS. 1 and 2, the transition strip 30 includes a first side edge 44, a second side edge 46, and an interconnecting skin 48. The skin 48 faces the cavity 33 and cooperates with generally planar skins on each of the panels 34, 36 to form a generally planar concrete-forming surface as would be known.

In accordance with the disclosed example, the transition strip 30 will preferably be approximately eight inches (8") in width. This width will allow sufficient clearance for most commercially available clamps, such that the clamps will not interfere with the other side of the transition strip 30. Other widths may be chosen depending on the dimensions of the clamps.

Figure 3:
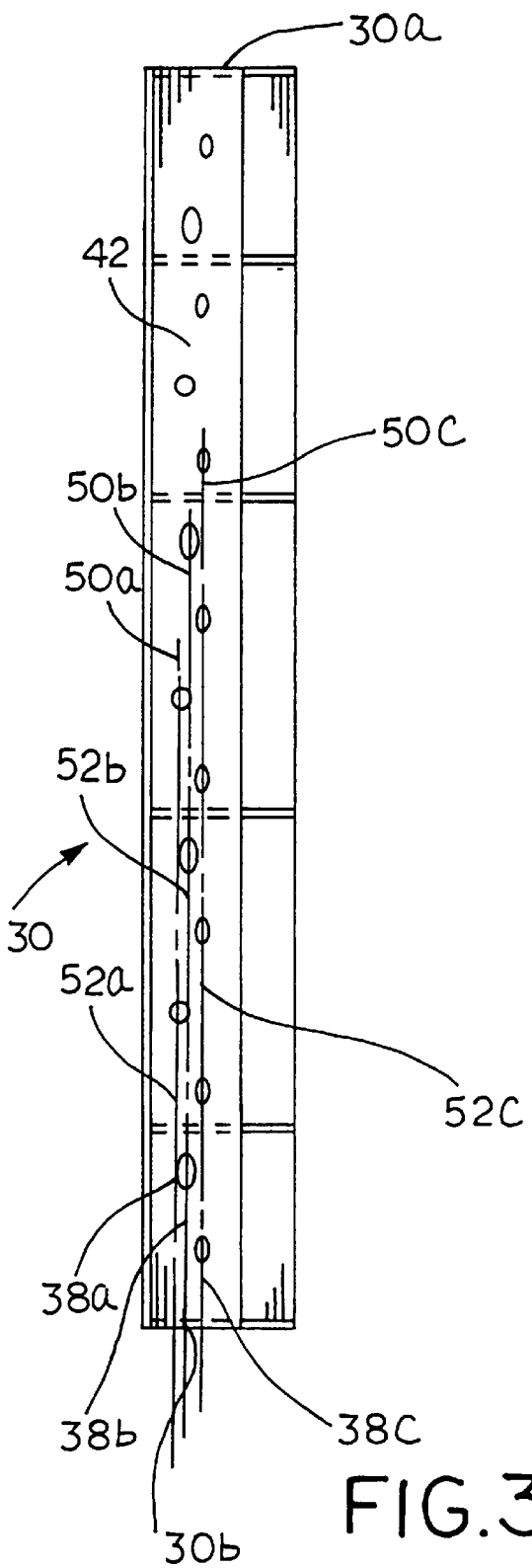
FIG. 3 is left side elevational view taken along line 3—3 of FIG. 2.

As shown in FIGS. 1, 2 and 3, the first side edge 44 of the transition strip 30 includes a plurality of sets of bolts holes 50*a*, 50*b*, and 50*c* arranged along a plurality of gage lines 52*a*, 52*b*, and 52*c*, respectively. The first side edge 44 may include additional or fewer gage lines (not shown) to the extent practical as dictated by the available space. The set of bolt holes 50*a* may be arranged according to a first one of the patterns 38*a*, the set of bolt holes 50*b* may be arranged according to a second one of the patterns 38*b*, and the set of bolt holes 50*c* may be arranged according to a third one of the patterns 38*c*.

It will be appreciated that the set of bolt holes 50*a* along the gage line 52*a* will match the pattern 38*a*, the set of bolt holes 50*b* along the gage line 52*b* will match the pattern 38, and the set of bolt holes 50*c* along the gage line 52*c* will match the pattern 38*c*. Thus, the first side edge 44 of the transition strip 30 may be suitably attached to any one of three possible first wall panels (e.g., a first wall panel employing the pattern 38*a*, a first wall panel employing the pattern 38*b*, or a first wall panel employing the pattern 38*c*). It will be noted that the three gage lines 52*a*, 52*b*, 52*c* may be disposed at three different distances relative to the skin 48 of the transition strip 30.

As shown in FIG. 3, the holes 50*a* may be spaced apart along the length of the transition strip 30 a distance A, the holes 50*b* may be spaced apart along the length of the transition strip 30 a distance B, while the holes 50*c* may be spaced apart along the length of the transition strip 30 a distance C. These spacings are intended to match the spacing of corresponding holes for the first panel 34, which as outlined above may employ one of a number of possible bolt patterns.

Figure 4:
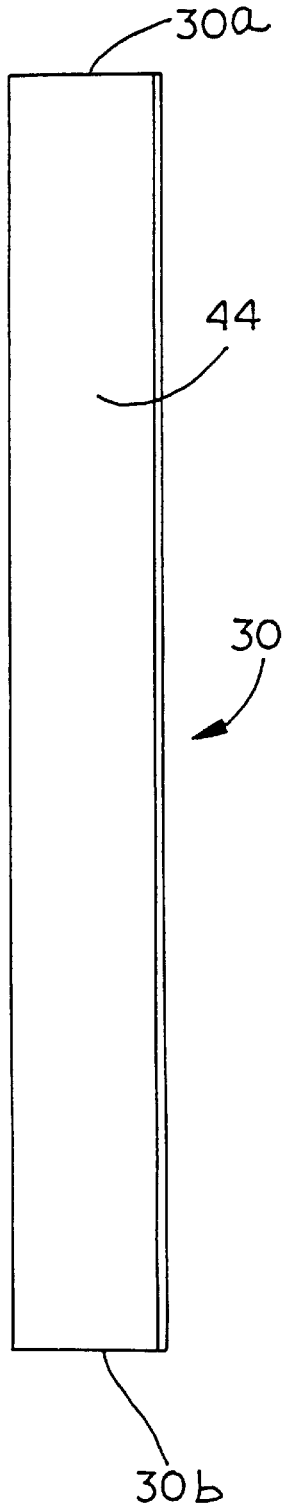
FIG. 4 is a right side elevational view taken along line 4—4 of FIG. 2.

Referring now to FIGS. 1, 2 and 4, the second side edge 46 of the transition strip 30 includes a shaped side member 54. The shaped side member 54 is sized and shaped to mate with the shaped side member 40 on the vertical side edge 36*a* of the wall panel 36. The shaped side member 40 and the shaped side member 54 may be shaped and constructed to match any one of a number of possible cross-sections (see FIGS. 1, 2, 7 and 8 for one possible example, and FIGS. 9 and 10 for another possible example). Other identical or complementary cross-sections may be contemplated. Thus, the second side edge 46 of the transition strip 30 may be joined to the vertical edge 36*a* of the wall panel 36 using the clamp 42 (shown in FIG. 8).

As shown in FIGS. 1–4, the transition strip 30 may include a top gusset plate 56, a bottom gusset plate 58 (FIGS. 1, 3, 4 and 5), and a plurality of intermediate gusset plates 60 (FIGS. 1, 3, 4 and 6) spaced at intervals along a length of the transition strip 30. As shown in FIGS. 1 and 2, the gusset plates 56, 58 and 60 are preferably attached by welding or other suitable means to an inside face 62 of the first side edge 44, an inside face 64 of the second side edge 46, and to a rear face 66 of the skin 48 (the rear direction signifying away from the concrete cavity 33).

Figure 5:
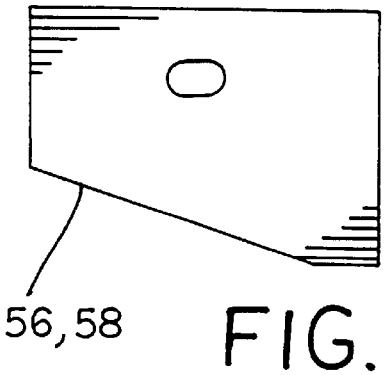
FIG. 5 is an enlarged fragmentary view of an end gusset plate.
Figure 6:
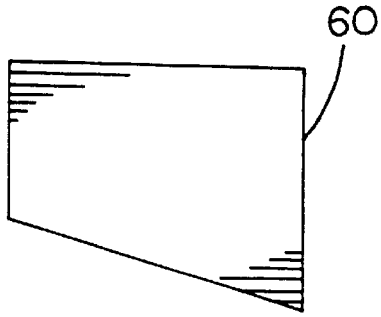
FIG. 6 is an enlarged fragmentary view of an interior gusset plate.

As shown in FIGS. 5 and 6, the top gusset plate 56 and the bottom gusset plate 58 may be slightly longer and larger than the intermediate gusset plates 60. Thus, the top and bottom gusset plates 56, 58 may help to prevent concrete from entering the hollow interior spaces in the shaped side member 54 (FIG. 7).

Referring now to FIGS. 1, 2, 7 and 8, the shaped side member 54 includes a generally central indentation or recess 68 bounded by a pair of widened sections 70, 72. As mentioned above, the shaped side member 54 is the same or substantially similar to the side member 40 on the vertical edge 36*a* of the second wall panel 36, such that the transition strip 30 and the wall panel 36 may be joined using the clamp 42. As shown in FIG. 1, the shaped member 54 may be constructed in discrete sections that extend between adjacent ones of the various gusset plates. For example, an upper end 74 of a section 54*a* of the shaped member 54 may be welded to the underside of the top gusset plate 56, while a lower end 76 of the section 54*a* may be welded to the top surface of the next lower intermediate gusset plate 60. Other suitable manners of construction and fabrication may become evident to those of skill in the art. Thus, except for the interruptions by the intermediate gusset plates 60, the recess 68 extends substantially between a top 30*a* and a bottom 30*b* of the transition strip 30. Alternatively, the shaped member 54 may extend substantially uninterrupted between the top 30*a* and the bottom 30*b* of the transition strip 30, with each of the gusset plates shaped to mate with the shaped member 54.

Figure 7:
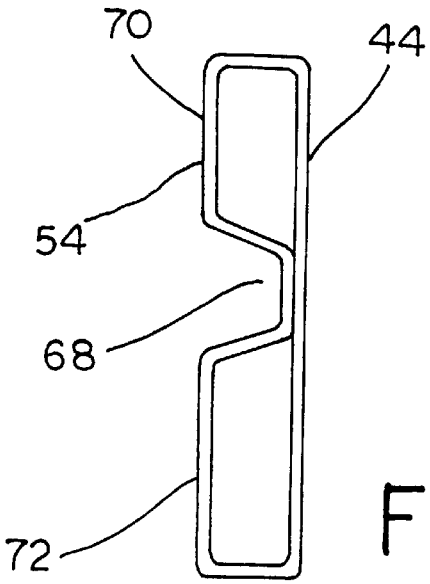
FIG. 7 is an enlarged fragmentary view of a shaped edge member.
Figure 8:
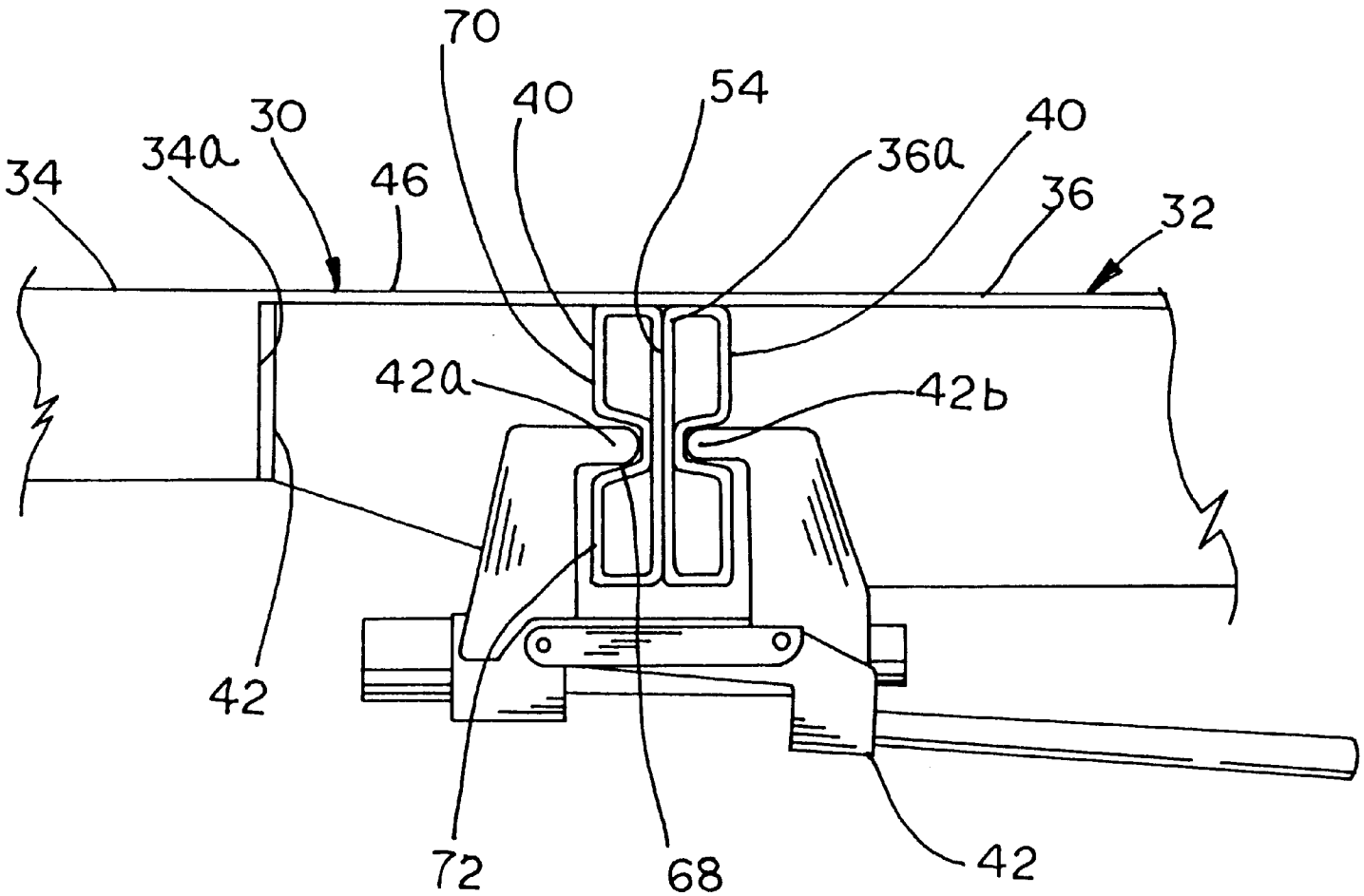
FIG. 8 is top plan view of the transition strip disposed between a pair of disparate wall form panels, with one side of the transition strip secured to one of the wall from panels using a clamping member.

Referring now to FIGS. 7 and 8, the vertical edge 36*a* of the second wall panel 36 includes a similarly shaped member 41. The clamp 42 includes a pair of ends 42*a*, 42*b* (FIG. 8). It will be appreciated that the recess 68 will be sized and shaped as required to receive the ends 42*a* and 42*b* of the clamp 42. Other clamps (not shown) may be chosen. Should the shape of the ends 42*a*, 42*b* be different from that shown, or should a different clamp be chosen, the shaped member 54, including the recess 68, may be shaped accordingly. Upon proper adjustment of the clamp 42, the second side edge 46 of the transition strip 30 may be suitably secured to the vertical side edge 36*a* of the second wall panel 36.

In operation, the transition strip 30 is used to form a transition between the first wall panel 34 and the second wall panel 36, by joining the vertical side edge 34*a* of the first wall panel 34 to the first side edge 44 of the transition strip, and by joining the vertical edge 36*a* of the second wall panel 36 to the second side edge 46 of the transition strip 30. It will be noted that the first wall panel 34 and the second wall panel 36 differ in a number of respects, such as, for example, thickness, and method of attachment to adjacent panels.

The transition strip 30 permits the attachment of the wall panel 34 employing a bolt-together construction (which may take the form of conventional bolts or wedge bolts), to the wall panel 36 employing a clamp system, such as the clamp 42 shown in FIG. 8. Thus, the disparate wall form panels 34, 36 may be employed in the same wall-forming application.

It will be understood that the wall panels may further differ in other respects as well. For example, the wall panel 34 may be constructed to a first measurement standard (i.e., the metric standard), while the wall form 36 may be constructed to a second measurement standard (i.e., the imperial standard), or vice-versa.

Figure 9:
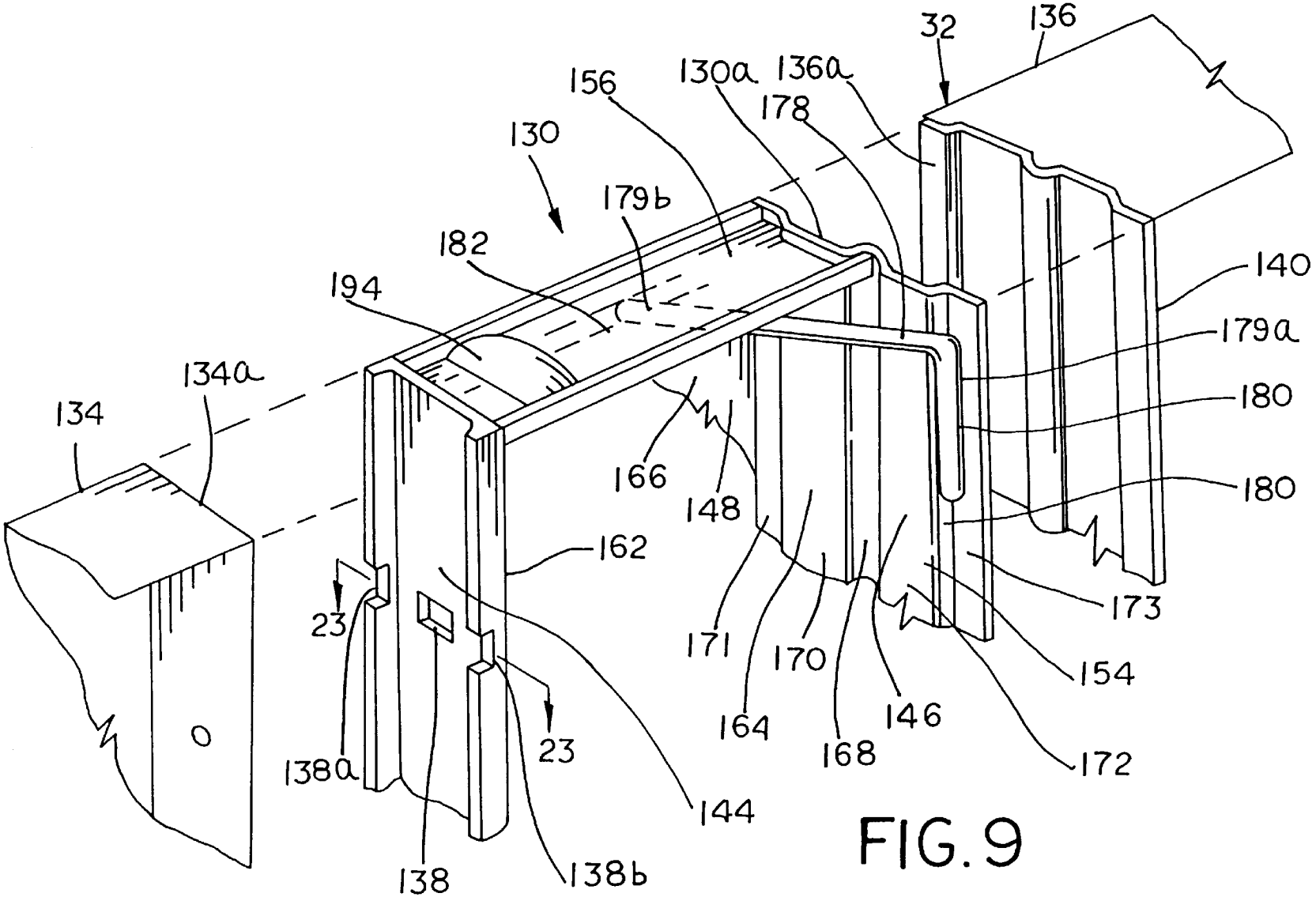
FIG. 9 is a fragmentary view in perspective of a transition strip constructed in accordance with the teachings of a second disclosed embodiment of the present invention.
Figure 23:
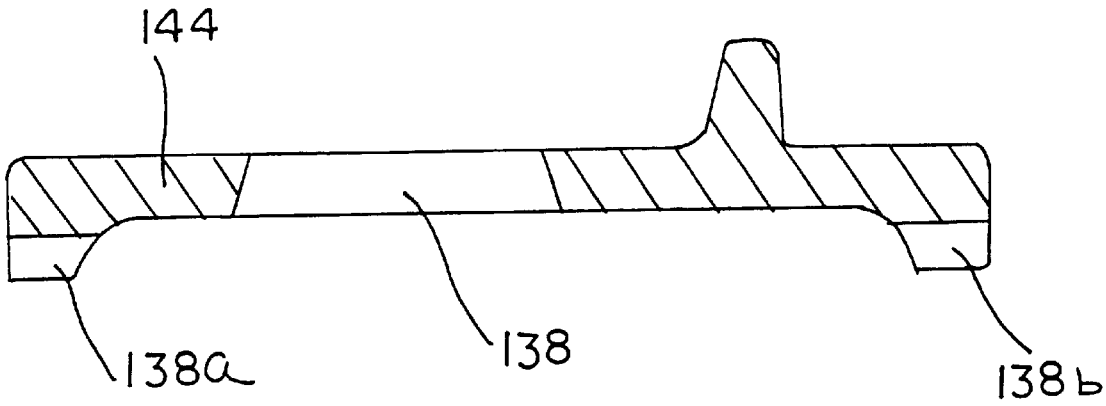
FIG. 23 is an enlarged cross-sectional view of one side edge of the transition strip.
Figure 24:
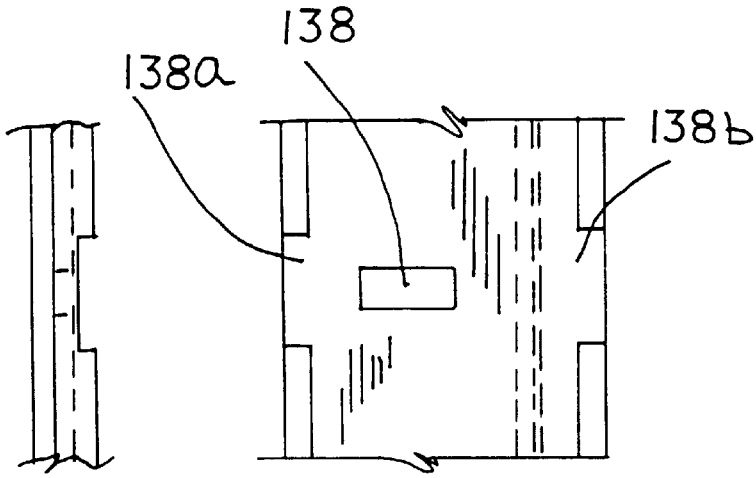
FIG. 24 is an enlarged fragmentary elevational view taken along line 24—24 of FIG. 23.

Referring now to FIGS. 9–22 of the drawings, a transition strip constructed in accordance with the teachings of a second disclosed embodiment of the present invention is shown and is generally referred to by the reference numeral 130. To the extent possible, all elements that are the same or similar to first disclosed embodiment will retain the same reference number, albeit increased by 100. As shown in FIG. 9, the transition strip 130 is used to assemble the modular wall form system 32 described above having a plurality of wall panels 134, 136. The wall panel 134 includes a vertical edge 134*a*, while the wall panel 136 includes a vertical edge 136*a*. The vertical edge 134*a* of the wall panel 134 includes a plurality of attachment holes as would be known and which are typically spaced at a standardized interval along the vertical edge 134*a* according to one of a number of possible standardized patterns. The transition strip 130 includes a first side edge 144, a second side edge 146, and a skin 148. The first side edge 144 includes a series of holes 138 spaced at intervals along the length of the transition strip 130. As shown in FIGS. 23 and 24, each of the holes 138 is straddled by a pair of notches 138*a*, 138*b* in the first side edge 144 of the transition strip 130. The holes 138 and the notches 138*a*, 138*b* will be spaced along the side edge 144 in order to match or be suitably complementary with the standardized pattern on the wall panel 134, thus enabling attachment of the vertical edge 134 of the wall panel 134 to the side edge 144 of the transition strip 130. The notches 138*a*, 138*b* allow for placement of a tie or other suitable assembly hardware, such as, for example, a wedge bolt. Preferably, the notches 138*a*, 138*b*, and the hole 138 are rectangular, with the notches 138*a*, 138*b* being along a centerline of the hole 138.

Figure 10:
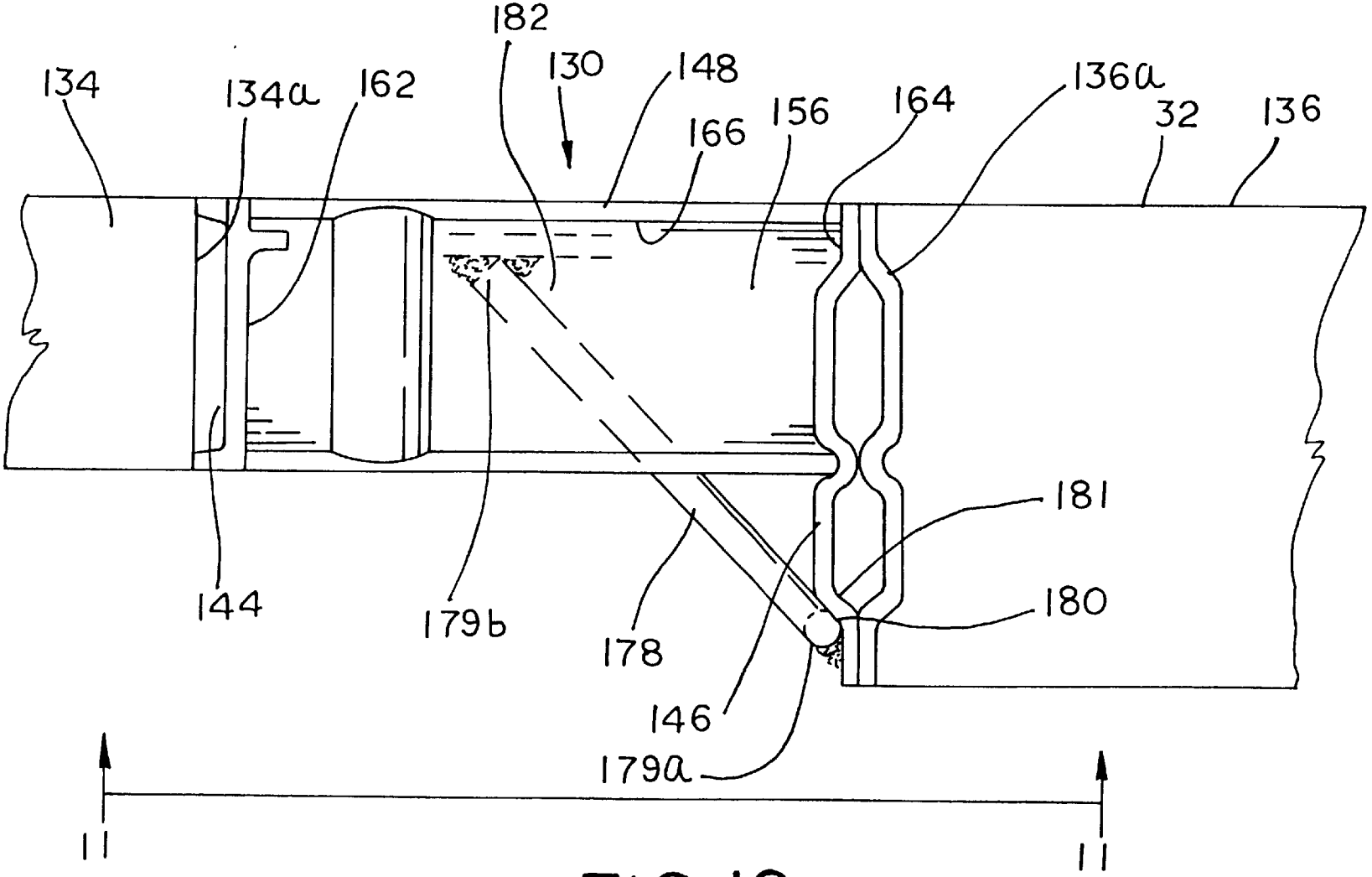
FIG. 10 is a top plan view of the transition strip shown in FIG. 9.

As shown in FIGS. 9 and 10, the vertical edge 136*a* of the wall panel 136 includes a shaped side member 140. The shaped side member 140 is sized and shaped to accept a standardized attachment clamp of the type commonly employed in the art. The shaped side member 140 thus facilitates the attachment of the vertical edge 136*a* of the wall panel 136 to the side edge 146 of the transition strip 130. As would be known to those of skill in the art, the details of the cross-section of the shaped side member 140 may vary according to one of a number of possible standardized forms in order to facilitate the use of one of a number of possible attachment clamps.

As shown in FIGS. 9 and 10, the transition strip 130 includes a first side edge 144, a second side edge 146, and an interconnecting skin 148. The skin 148 faces the cavity 133 and cooperates with generally planar skins on each of the panels 134, 136 to form a generally planar concrete-forming surface as would be known.

Figure 11:
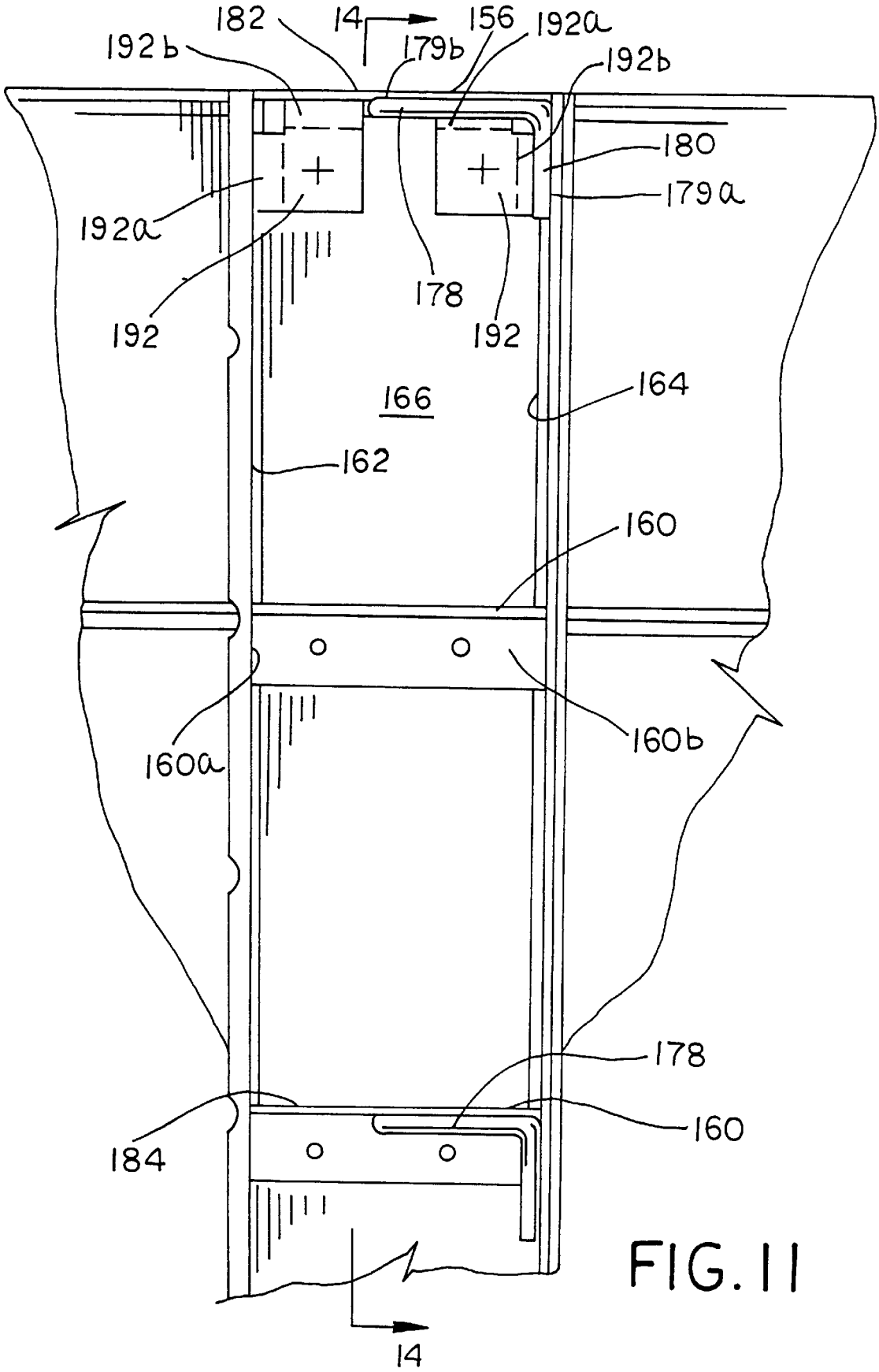
FIG. 11 is an elevational view of the transition strip shown in FIG. 9.
Figure 12:
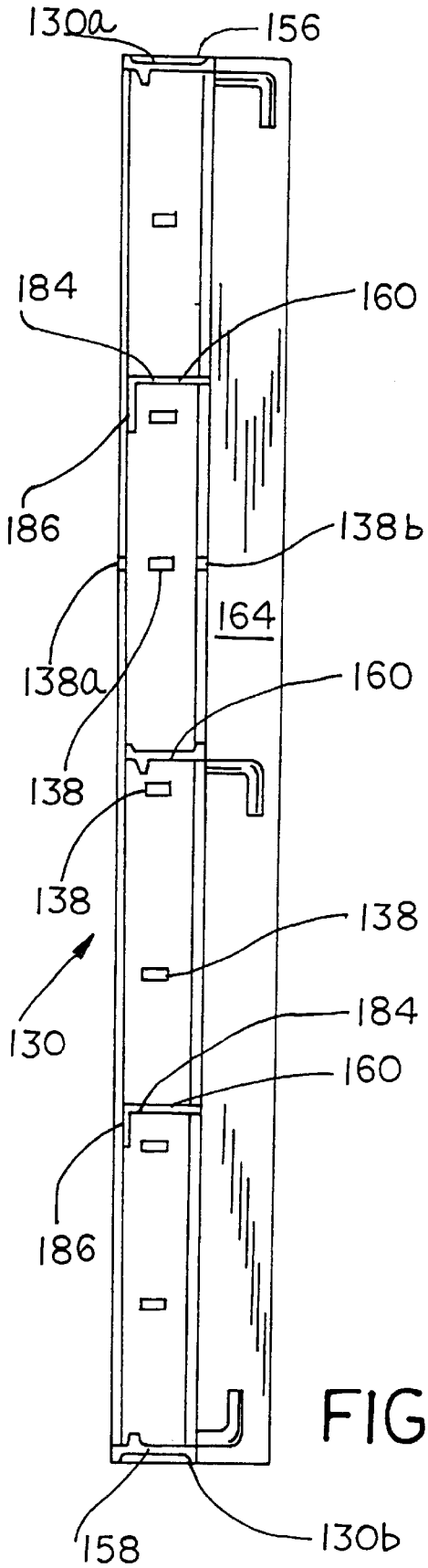
FIG. 12 is a left side elevational view taken along line 12—12 of FIG. 11.
Figure 13:
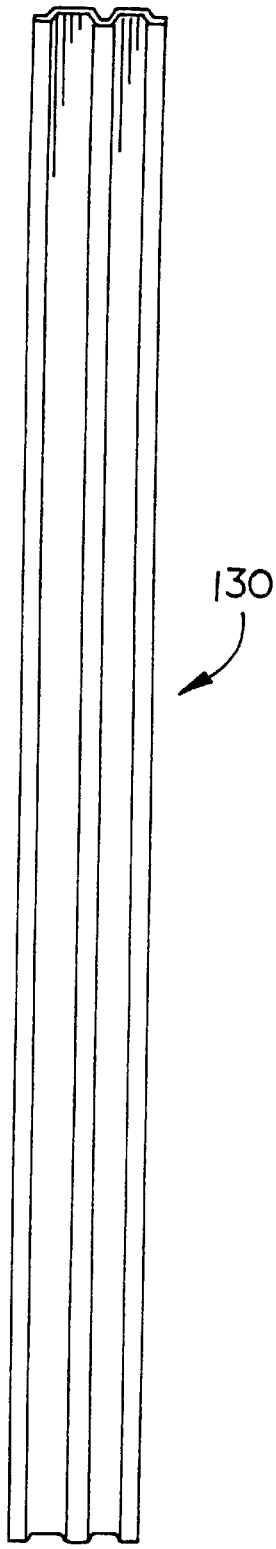
FIG. 13 is a right side elevational view taken along line 13—13 of FIG.
Figure 14:
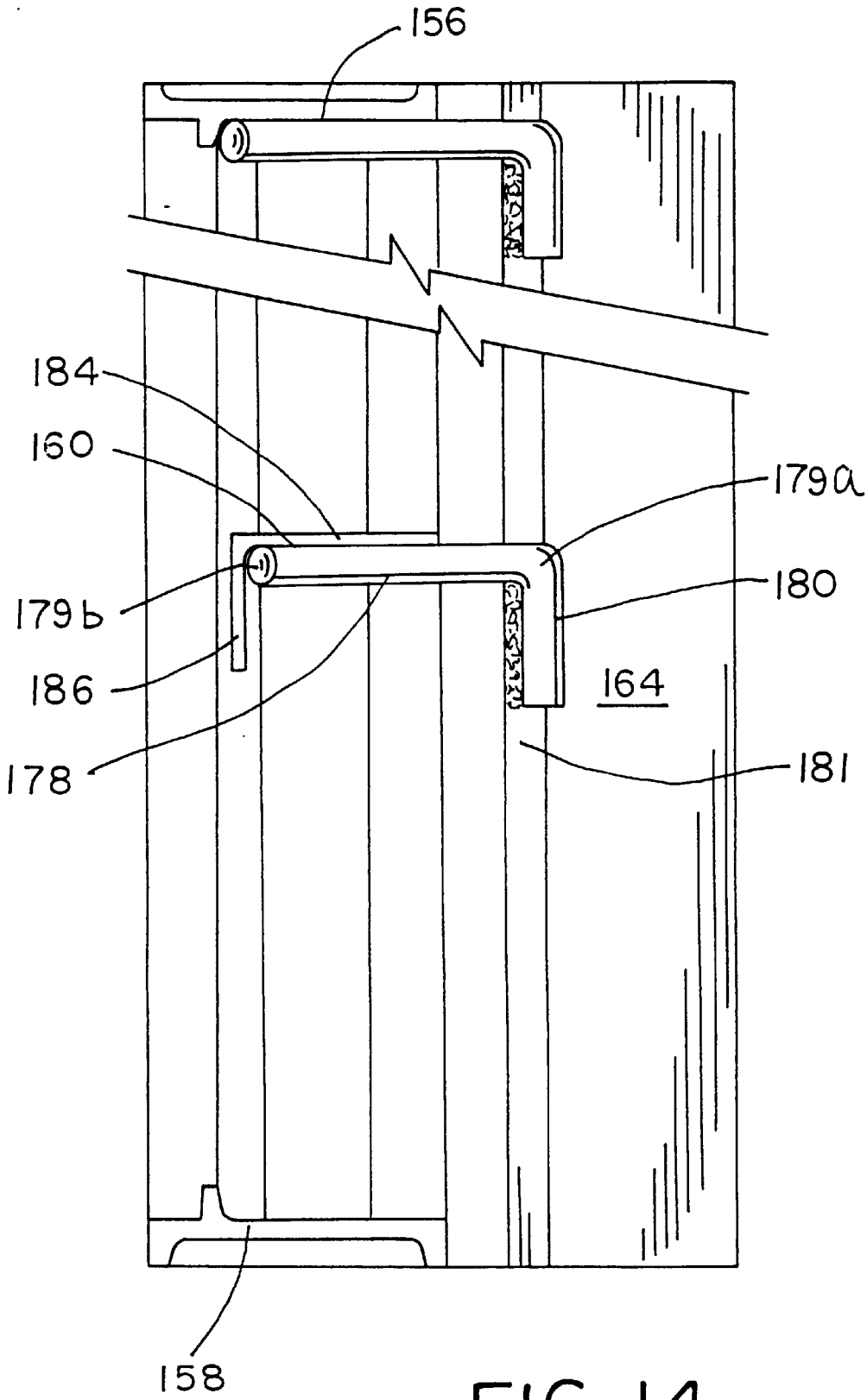
FIG. 14 is an enlarged fragmentary cross-sectional view taken along line 14—14 of FIG. 11.
Figure 15:
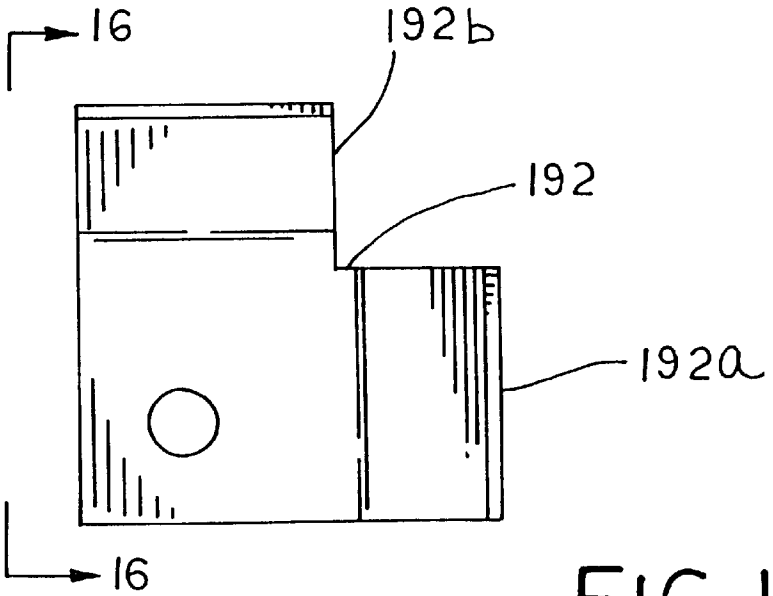
FIG. 15 is an enlarged plan view of a corner brace.
Figure 17:
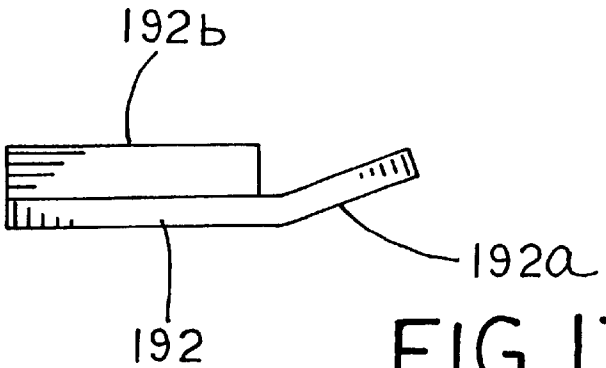
FIG. 17 is a side elevational view taken along line 17—17 of FIG. 15.
Figure 16:
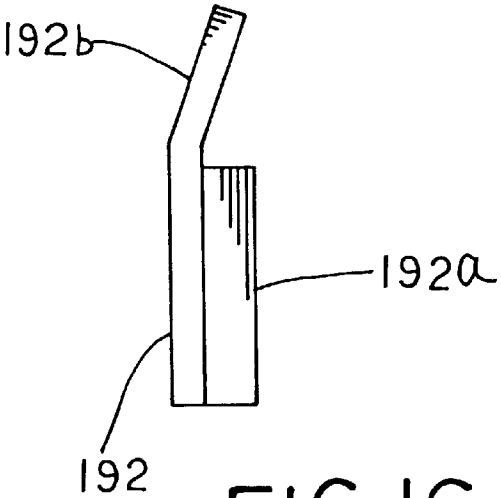
FIG. 16 is a side elevational view taken along line 16—16 of FIG. 15.
Figure 18:
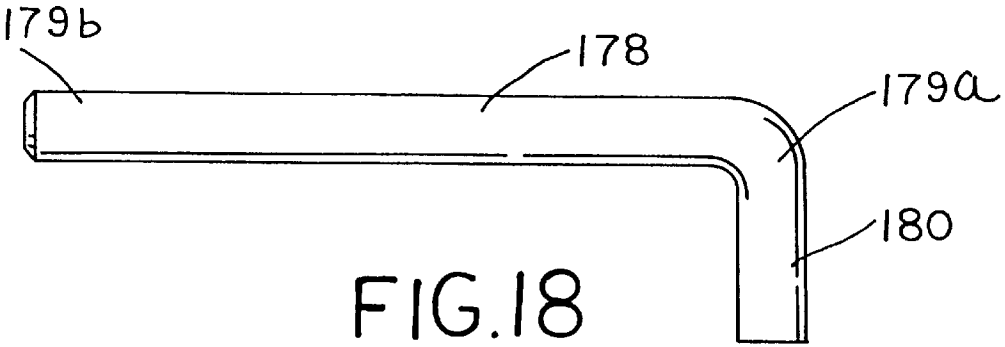
FIG. 18 is an enlarged fragmentary plan view of a diagonal brace.

As shown in FIGS. 9–12 and 14, the transition strip 130 may include a top gusset plate 156, a bottom gusset plate 158 (FIGS. 10–12), and a plurality of intermediate gusset plates 160 (FIGS. 11, 12 and 14) spaced at intervals along a length of the transition strip 130. The gusset plates 156, 158 and 160 are preferably attached by welding or other suitable means to an inside face 162 of the first side edge 144 and to an inside face 164 of the second side edge 146. The top gusset plate 156 and the bottom gusset plate 158 may be slightly longer and larger than the intermediate gusset plates 160. Thus, the top and bottom gusset plates 156, 158 may help to prevent concrete from entering the hollow interior spaces in the shaped side member 154. At least the top and bottom gusset plates 156, 158 may also be secured such as by welding to a rear face 166 of the skin 148 (FIGS. 9, 10 and 11).

Referring now to FIGS. 9 and 10, the shaped side member 154 includes a generally central indentation or recess 168 bounded by a pair of widened sections 170, 172. Each of the widened sections 170, 172 terminates in a small flange 171, 173, respectively. As shown in FIG. 9, the shaped member 154 may be a continuous section extending between a top end 130*a* and a bottom end 130*b* of the transition strip 130.

The vertical edge 136*a* of the second wall panel 136 includes the shaped member 140. Preferably, the shaped side member 154 is shaped substantially similar to the member 140, or, alternatively, is shaped to be complementary with the shape of the member 140. A standardized clamp (not shown) includes a pair of ends which are sized to extend into the recess 168 on both the side edge 146 of the transition strip and the vertical side edge 136*a* of the panel 136. Again, the recesses 168 are sized and shaped as required to receive the ends of the clamp. Upon proper adjustment of the clamp, the second side edge 146 of the transition strip 130 may be suitably secured to the vertical side edge 136*a* of the second wall panel 136.

As shown in FIGS. 9, 10, 11, 12 and 14, the transition strip 130 also includes a plurality of stiffeners or braces 178 which are spaced at intervals along the length of the transition strip 130. Each of the braces 178 may be welded or otherwise suitably secured to the shaped member 154, such as at an interface 181 (FIGS. 9, 10 and 14) between the widened section 172 and the flange 173, as well as to a corresponding one of the gussets 156, 158 or 160. Each brace 178 includes a first end 179*a* and a second end 179*b*. The end 179*a* may include a bent section 180 which may provide additional surface area for welding to the shaped member 154. As shown in FIGS. 9, 10, 11 and 14, the end 179*b* may be welded to a central web 182 of the gussets 156, 158, or to a central web 184 of the gusset 160.

The gusset 160 is preferably an angled section having the web 184 and a flange 186 (FIGS. 12, 14, and 21–22). As shown in FIG. 11, the gusset 160 includes a pair of ends 160*a* and 160*b*, which are suitably secured to the side edge 144 and the shaped member 154, respectively, of the transition strip 130. Preferably, the end 160*b* is shaped to mate with a portion of the shaped member 154.

Figure 19:
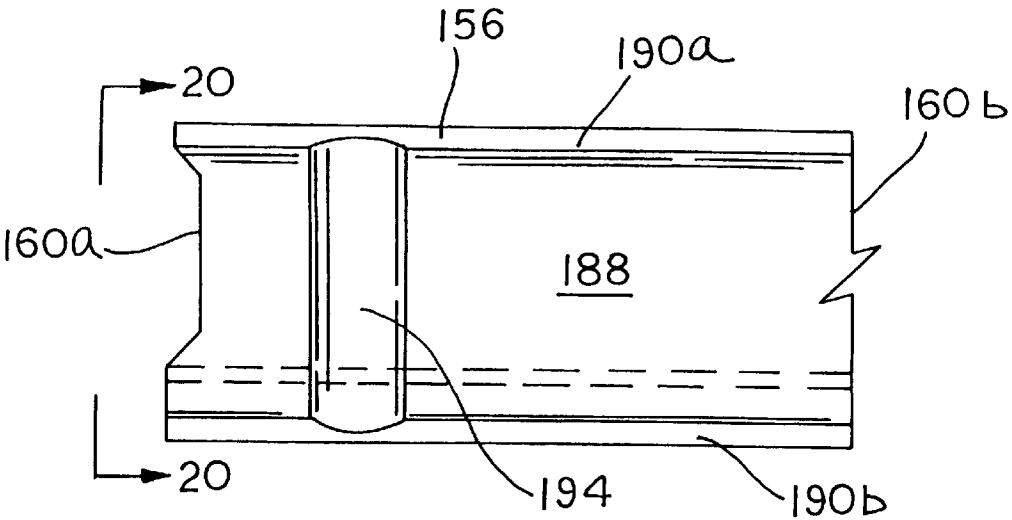
FIG. 19 is an enlarged elevational view of an end rail.
Figure 20:
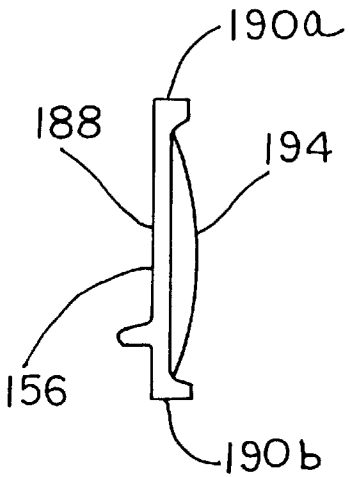
FIG. 20 is a side elevational view taken along line 20—20 of FIG. 19.
Figure 21:
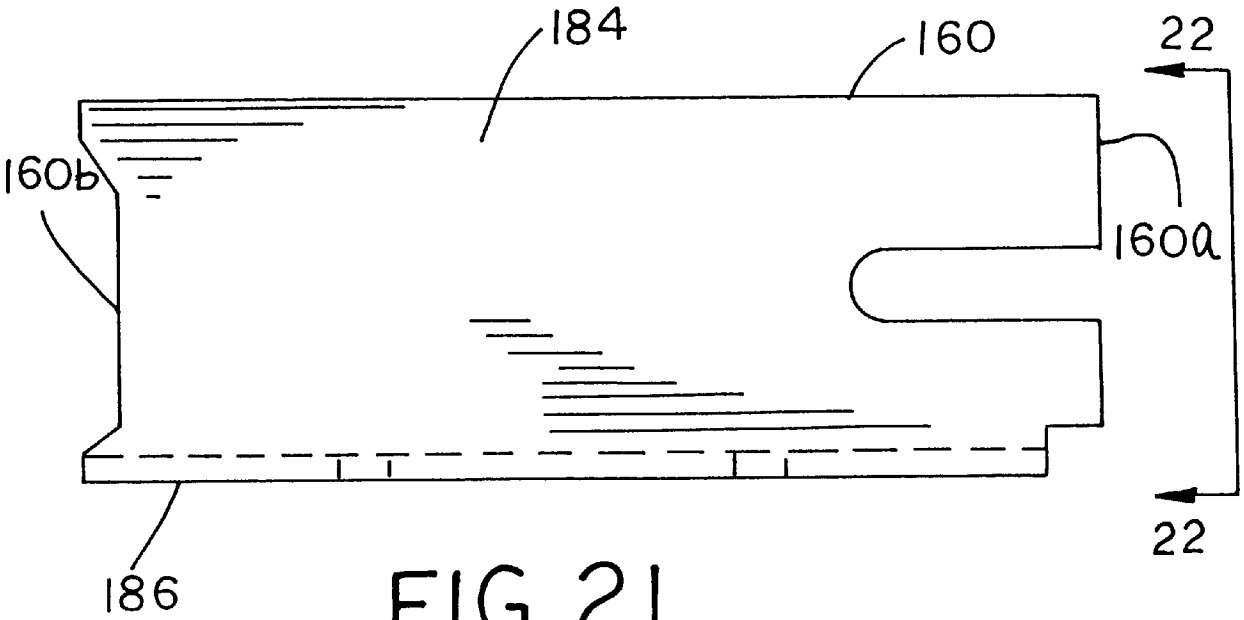
FIG. 21 is an enlarged elevational view of an intermediate cross-member.
Figure 22:
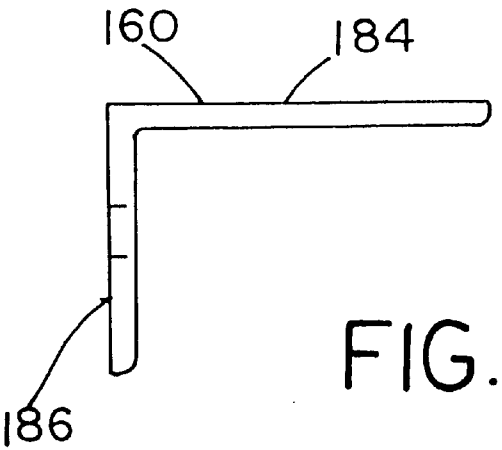
FIG. 22 is a side elevational view taken along line 22—22 of FIG. 21.

As shown in FIGS. 19 and 20, the gusset 156 preferably includes a web 188 and a pair of flanges 190*a*, 190*b*. The gusset 156 includes a pair of ends 160*a* and 160*b*, which may be suitably secured to the shaped member 154 and the first side edge 144 of the transition strip 130. Preferably, the ends 160*a* are shaped to mate with a portion of the shaped member 154. The gusset plate 158 may be substantially similar.

Referring now to FIGS. 11 and 15–17, a number of corner braces 192 may be provided. Each corner brace may include a pair of angled tabs 192*a*, 192*b*, which tabs facilitate attachment of the corner braces to either the gusset plate 156 and the side edge 144, or the gusset plate 156 and the side edge 146. The bottom gusset plate 158 may include similar braces.

Preferably, the top and bottom gusset plates in any of the disclosed embodiments will include a curved emboss 194 (FIGS. 9, 19 and 20), which helps to minimize interlocking when the form components are stacked on top of each other.

Figure 25:
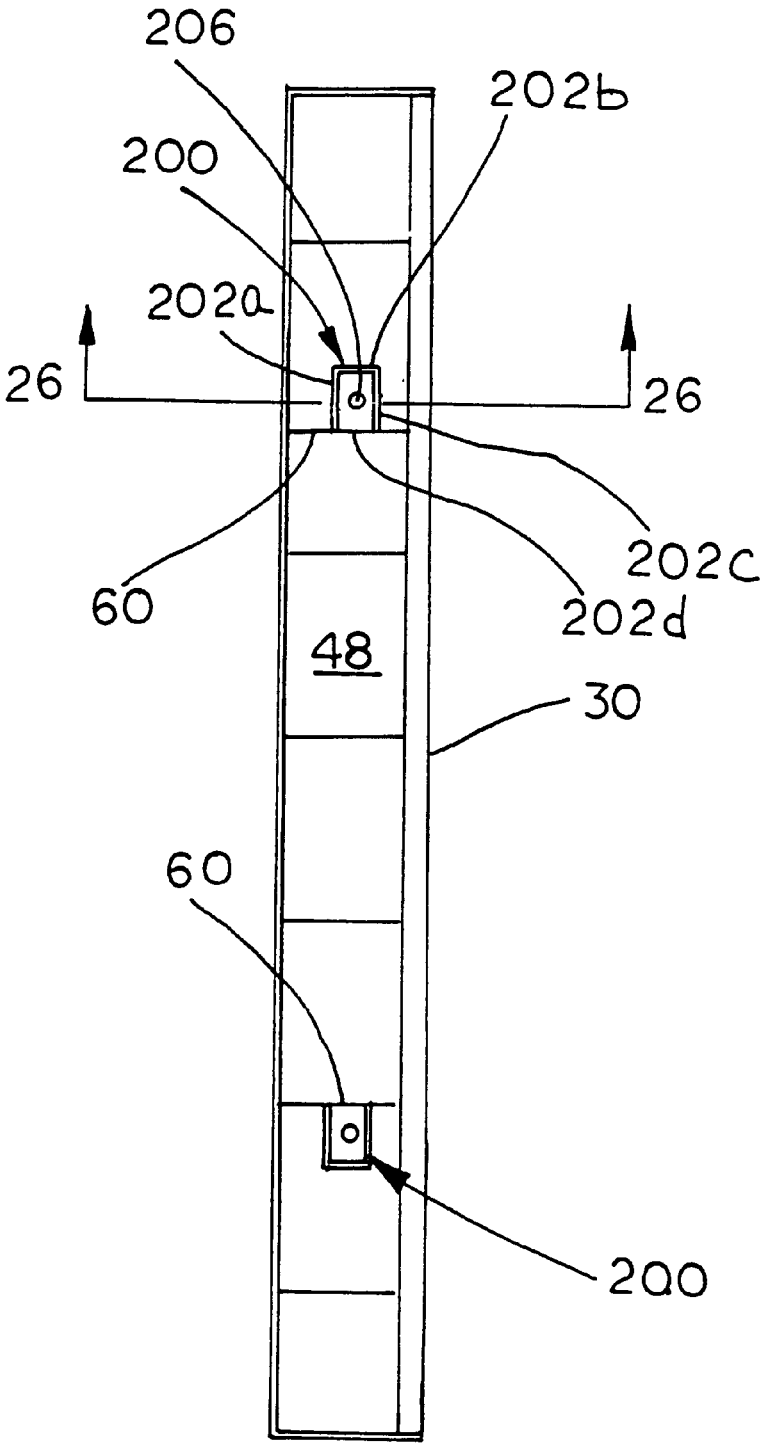
FIG. 25 is an elevational view of a transition strip according to any of the preceding embodiments and employing an optional tie box.
Figure 26:
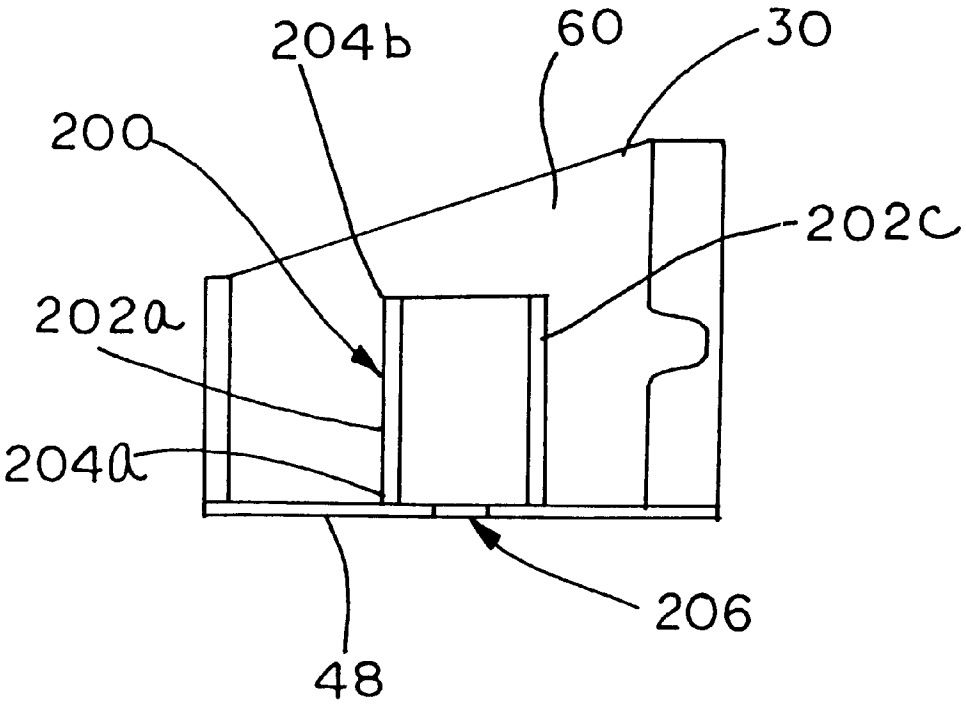
FIG. 26 is a cross-sectional view taken along line 26—26 of FIG. 25.

Referring now to FIGS. 25 and 26, the transition strip 30 shown therein (or the transition strip 130) may optionally include a tie box 200. The tie box 200 will accommodate a conventional cross tie that extends through the concrete to a corresponding form panel on the other side of the concrete structure to be poured. Any number of suitable cross ties may be employed, and the dimensions of the tie box 200 may be altered accordingly as necessary. The tie box 200 includes four walls 202*a*, 202*b*, 202*c* and 202*d*. The walls 202*a–d* may be welded to each other or formed using any other suitable construction. For example, the wall 202*a* may be welded to the walls 202*b* and 202*d* along seams defined by the interface between the joining walls. The remaining walls may be joined to their adjacent walls along common seams in a similar manner. Alternatively, the tie box 200 may be formed of a relatively short tubular section or, as another alternative, the tie box 200 may be bent from a flat section which is then joined, for example, at one of the corners or along a seam defined by one of the walls. As a still further alternative, the tie box 200 may be formed from three suitable walls (e.g., 202*a–c*) with at least one of the walls (e.g., 202*d*) conveniently being formed by one of the gusset plates, such as one of the intermediate gusset plates 60. In such an instance the gusset plate 60 and the tie box 200 may significantly stiffen the skin 48 in the region of the tie box 200.

The tie box 200 includes an inner end 204*a* (FIG. 26) that is mounted to the skin 48, such as by welding or by using any type of suitable bolt-on mounting bracket, and an outer end 204*b*. The skin 48 will be provided with a suitable hole 206 that is sized to receive the chosen cross tie. A washer or other suitable plate or structure may be placed over the outer end 204*b* to provide a suitable bearing surface and to transmit the load form the cross tie to the tie box 200 and hence to the transition strip 30.

A transition strip assembled in accordance with the teachings of the present invention will permit the two disparate modular concrete forms (e.g., a form employing a clamp system attachment and a form employing a bolt system attachment) to be used side-by-side in a common application. Further, a transition strip assembled in accordance with the teachings of the present invention will permit the two disparate modular concrete forms to be used side-by-side despite different attachment bolt patterns. Further, a transition strip assembled in accordance with the teachings of the present invention will permit the two disparate modular concrete forms (e.g., an imperial form and a metric form) to be used side-by-side in a common application.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed:

1. A transition system for joining a first concrete-forming panel to a second concrete-forming panel, the system comprising:

a first concrete-forming panel having a first thickness and arranged to receive a first attachment mechanism;

a second concrete-forming panel having a second thickness, the second thickness greater than the first thickness, the second concrete-forming panel arranged to receive a second attachment mechanism; and a transition strip sized for placement between the first and second concrete-forming panels, the transition strip further including:

a first side edge, the first side edge sized to match the first thickness, the first side edge arranged to receive the first attachment mechanism;

a second side edge, the second side edge sized to match the second thickness, the second side edge arranged to receive the second attachment mechanism; and a skin having a concrete forming face extending between the first and second side edges, the skin arranged to cooperate with the first concrete-forming panel and the second concrete-forming panel to form a generally uninterrupted concrete-forming surface; and a plurality of stiffeners extending between the first side edge and the second side edge.

2. The system of claim 1, wherein the first side edge includes a plurality of bolt holes arranged along a plurality of vertically oriented gage lines, the bolt holes of a first one of the gage lines spaced apart a first distance, the bolts holes of a second one of the gage lines spaced apart a second distance.

3. The system of claim 2, wherein the second side edge includes a shaped member, the shaped member adapted for engagement by a clamping system.

4. The system of claim 3, wherein the shaped member includes vertically oriented recess sized for engagement by the clamping system.

5. The system of claim 4, wherein the shaped member includes at least one stiffener having a first portion disposed proximate the recess.

6. The system of claim 5, comprising a pair of stiffeners each having a first portion disposed proximate the recess and a second portion straddling the recess.

7. The system of claim 1, wherein the first side edge includes a plurality of bolt holes arranged along a plurality of vertically oriented gage lines, the bolt holes of a first one of the gage lines arranged according to a first attachment standard, the bolt holes of a second one of the gage lines arranged according to a second attachment standard, and further wherein the second side edge includes a shaped member having a vertically oriented recess, the recess sized for engagement by a clamping system.

8. The system of claim 7, wherein the transition strip includes a plurality of gusset plates extending between the first side edge and the second side edge, and wherein the shaped member extends between each of the gusset plates.

9. The system of claim 7, wherein the attachment holes of at least one of the plurality of gage lines are slotted.

10. A transition strip for joining a first concrete-forming panel to a second concrete-forming panel, the first concrete-forming panel having a first thickness and arranged to receive a first attachment mechanism, the second concrete-forming panel having a second thickness greater than the first thickness and arranged to receive a second attachment, the transition strip comprising:

a first side edge, the first side edge sized to match the first thickness, the first side edge arranged to receive the first attachment mechanism;

a second side edge, the second side edge sized to match the second thickness, the second side edge arranged to receive the second attachment mechanism; and a skin having a concrete forming face extending between the first side edge and the second side edge; and a plurality of braces extending between the first side edge and the second side edge.

11. The transition strip of claim 10, the first attachment mechanism including a plurality of bolts, and wherein the first side edge includes a plurality of first bolt holes arranged along a first vertically oriented gage line, the first side edge further including a plurality of second bolt holes arranged along a second vertically oriented gage line, and wherein the first bolt holes are spaced apart a first distance and further wherein the second bolt holes are spaced apart a second distance.

12. The transition strip of claim 11, the second attachment mechanism comprising a clamp, and wherein the second side edge includes a shaped member, the shaped member adapted for engagement by the clamp.

13. The transition strip of claim 12, wherein the shaped member includes at least one vertically oriented stiffener.

14. The transition strip of claim 12, wherein the shaped member is stiffened.

15. The transition strip of claim 10, the second attachment mechanism including a clamp, and wherein the braces comprise gusset plates and the second side edge includes stiffening means extending between a gusset plates plate and the second side edge for stiffening the second side edge, the stiffening means further adapted for engagement by the clamp.

16. The transition strip of claim 11, wherein the attachment holes of at least one of the first and second gage lines are slotted.

17. The transition strip of claim 11, wherein the braces comprise a plurality of rods.

18. The transition strip of claim 17, wherein the rods extend between a rear face of the skin and at least one of the first side edge and the second side edge.

19. The transition strip of claim 11, wherein the first side edge is adapted to receive wedge bolts.

20. A method of providing a transition between disparate concrete-forming panels, the method comprising the steps of:

providing a first concrete-forming panel having a first thickness and including a plurality of attachment holes arranged along a vertically oriented gage line to match a first bolt pattern;

providing a second concrete-forming panel having a first thickness and including a plurality of attachment holes arranged along a vertically oriented gage line to match a second bolt pattern;

providing a third concrete-forming panel having a second thickness, the second thickness greater than the first thickness, the second concrete-forming panel arranged to receive a second attachment mechanism; and providing a transition strip, the transition strip including:

a first side edge, the first side edge sized to match the first thickness, the first side edge including a plurality of attachment holes arranged along a plurality of vertically oriented gage lines, the plurality of attachment holes further arranged to match the first pattern and the second pattern;

a second side edge, the second side edge sized to match the second thickness, the second side edge arranged to mate with the second concrete-forming panel;

a skin between the first and second side edges; and a plurality of braces;

selecting one of the first and second concrete-forming panels;

securing the selected panel to the first side edge of the transition strip using attachment bolts arranged to engage the bolt pattern of the selected panel; and securing the third panel to the second side edge of the transition strip using the second attachment mechanism;

thereby defining a generally uninterrupted concrete-forming surface extending across the panels and the skin of the transition strip.

21. A transition strip for use in joining a first concrete-forming panel to a second concrete-forming panel, the first concrete-forming panel having a plurality of attachment holes arranged according to a first measurement standard, the second concrete-forming panel having a plurality of attachment holes arranged according to a second measurement standard, the transition strip comprising:

a first side edge, the first side edge including a plurality of attachment holes arranged according to the first measurement standard, the attachment holes of the first side edge spaced to correspond to selected attachment holes on the first concrete-forming panel;

a second side edge, the second side edge including a plurality of attachment holes arranged according to the second measurement standard, the attachment holes of the second side edge spaced to correspond to selected attachment holes on the second concrete-forming panel, the second side edge including a flange extending along a length of the second side edge;

a planar skin extending between the first and second side edges; and a plurality of gusset plates spaced along a length of the transition strip, the gusset plates mounted to the first and second side edges and the skin.

22. The transition strip of claim 21, wherein the attachment holes of the first side edge are arranged in a plurality of gage lines, and wherein the attachment holes of the second side edge are arranged in a plurality of gage lines.

23. The transition strip of claim 21, wherein the attachment holes of the first side edge are arranged along three gage lines, and wherein the attachment holes of the second side edge are arranged along three gage lines.

24. A transition strip for use in Joining a first concrete-forming panel to a second concrete-forming panel, the first concrete-forming panel having a plurality of attachment holes arranged according to a first measurement standard, the second concrete-forming panel having a plurality of attachment holes arranged according to a second measurement standard, the transition strip comprising:

a first side edge, the first side edge including first attachment means for permitting securement of the first side edge to the first concrete-forming panel;

a second side edge, the second side edge including second attachment means for permitting securement of the second side edge to the second concrete-forming panel;

a planar skin extending between the first and second side edges; and stiffening means for stiffening the transition strip.

25. The transition strip of claim 24, wherein the stiffening means includes a plurality of braces extending between the first side edge and the second side edge.

26. The transition strip of claim 25, wherein the braces comprise a plurality of gusset plates spaced along a length of the transition strip.

27. The transition strip of claim 25, wherein the braces comprise a plurality of diagonal rods spaced along a length of the transition strip and engaging a rear face of the skin and at least one of the first and second side edges.

28. A transition strip for use in joining a first concrete-forming panel to a second concrete-forming panel, the first concrete-forming panel having a plurality of attachment holes arranged according to a first measurement standard, the second concrete-forming panel having a plurality of attachment holes arranged according to a second measurement standard, the transition strip comprising:

a first side edge, the first side edge including first attachment means for permitting securement of the first side edge to the first concrete-forming panel;

a second side edge, the second side edge including second attachment means for permitting securement of the second side edge to the second concrete-forming panel;

a planar skin extending between the first and second side edges; and stiffening means for stiffening the transition strip;

wherein the stiffening means includes a plurality of braces extending between the first side edge and the second side edge; and wherein the braces comprise a plurality of diagonal rods spaced along a length of the transition strip and engaging a rear face of the skin and at least one of the first and second side edges.

* * * * *

UNITED STATES PATENT AND TRADEMARK OFFICE

CERTIFICATE OF CORRECTION

PATENT NO. : 6,755,387 B2
DATED : June 29, 2004
INVENTOR(S) : Lopez et al.

It is certified that error appears in the above-identified patent and that said Letters Patent is hereby corrected as shown below:

Column 1,
Line 24, reads "...that may be rapidly assembled and for use." and should read -- ...that may be rapidly assembled for use --.
Line 31, reads "...using metric dimension..." and should read -- ...using metric dimensions.. --.
Line 62, reads "...that employing disparate attachment mechanisms." and should read -- ...that employ disparate attachment mechanisms. --.

Column 2,
Line 5, reads "Fig. 3 is left side...view taken along..." and should read -- Fig. 3 is a left side...view taken along… --.
Line 16, reads "Fig. 8 is top plan view of…" and should read -- Fig. 8 is a top plan view of… --.
Line 19, reads "...one of the wall from panels using..." and should read -- ...one of the wall form panels using… --.
Line 31, reads "...taken along line 13-13 of FIG." and should read -- ...taken along line 13-13 of FIG.11. --.

Column 3,
Line 62, reads "...includes a plurality of sets of bolts holes..." and should read -- ...includes a plurality of sets of bolt holes… --.

Column 4,
Line 7, reads "...will match the pattern 38, and the..." and should read -- ...will match the pattern 38b, and the... --.

Column 8,
Line 6, reads "...transmit the load form the cross tie to..." and should read -- ...transmit the load from the cross tie to… --.
Line 61, reads "...the bolts holes of a second..." and should read -- ...the bolt holes of a second… --.

Column 9,
Line 2, reads "...includes vertically oriented recess…" and should read -- ...includes a vertically oriented recess… --.
Line 57, reads "The transition strip of claim 12, wherein..." and should read -- The transition strip of claim 11, wherein… --.
Line 62, reads "...between a gusset plates plate and the..." and should read -- ...between a gusset plate and the… --.

UNITED STATES PATENT AND TRADEMARK OFFICE

CERTIFICATE OF CORRECTION

PATENT NO. : 6,755,387 B2
DATED : June 29, 2004
INVENTOR(S) : Lopez et al.

It is certified that error appears in the above-identified patent and that said Letters Patent is hereby corrected as shown below:

Column 10,
Line 35-46, reads with the last four subparagraphs are indented too far.

Column 11,
Line 12, reads "...for use in Joining a..." and should read -- for use in joining a… --.

Column 12,
Lines 21-22, reads with this subparagraph running into the previous subparagraph.

Signed and Sealed this

Eighth Day of February, 2005

JON W. DUDAS
*Director of the United States Patent and Trademark Office*